US007234176B1

(12) United States Patent
Chiu

(10) Patent No.: US 7,234,176 B1
(45) Date of Patent: Jun. 26, 2007

(54) INFLATABLE SHAMPOO BASIN

(75) Inventor: Chia-Ching Chiu, Taipei (TW)

(73) Assignee: Homecare Products, Inc., Auburn, WA (US)

( * ) Notice: Subject to any disclaimer, the term of this patent is extended or adjusted under 35 U.S.C. 154(b) by 0 days.

(21) Appl. No.: 10/629,312

(22) Filed: Jul. 28, 2003

Related U.S. Application Data

(60) Provisional application No. 60/400,206, filed on Jul. 31, 2002.

(51) Int. Cl.
*A45D 19/08* (2006.01)
*A45D 19/04* (2006.01)

(52) U.S. Cl. ..... 4/519; 4/516

(58) Field of Classification Search ..... 4/515, 4/516, 519, 523, 619, 621
See application file for complete search history.

(56) References Cited

U.S. PATENT DOCUMENTS

| | | | | | |
|---|---|---|---|---|---|
| 1,738,411 | A | | 12/1929 | Welch | |
| 2,504,646 | A | | 4/1950 | Burrow | |
| 2,718,014 | A | * | 9/1955 | Mizrach et al. | 4/506 |
| 3,341,866 | A | | 9/1967 | Wright | |
| 3,816,858 | A | * | 6/1974 | Martin | 4/515 |
| D265,759 | S | | 8/1982 | Weber | |
| 4,419,774 | A | * | 12/1983 | Hajek | 4/519 |
| D293,363 | S | | 12/1987 | Everard | |
| D293,364 | S | * | 12/1987 | Everard | D23/289 |
| D306,473 | S | | 3/1990 | Scheurer | |
| 4,905,332 | A | | 3/1990 | Wang | |
| 5,101,823 | A | | 4/1992 | Smith | |
| 5,195,192 | A | | 3/1993 | Garde | |
| 5,245,713 | A | * | 9/1993 | Tickle | 4/516 |
| 5,247,712 | A | | 9/1993 | Williams | |
| 5,450,638 | A | | 9/1995 | Johnson | |
| 5,728,055 | A | * | 3/1998 | Sebastian | 602/19 |
| 6,209,150 | B1 | | 4/2001 | Hsu | |
| 6,230,338 | B1 | * | 5/2001 | Kirsch | 4/523 |
| 6,568,015 | B1 | | 5/2003 | Allen | |
| D478,971 | S | | 8/2003 | Jones | |
| D498,828 | S | | 11/2004 | Chiu | |
| 2004/0060117 | A1 | | 4/2004 | Chan | |

* cited by examiner

*Primary Examiner*—David J. Walczak
(74) *Attorney, Agent, or Firm*—Christensen O'Connor Johnson Kindness PLLC

(57) ABSTRACT

The inflatable basin (10) comprised of a bottom wall (12) and upwardly extending side walls (14), which extend around the perimeter of the bottom wall (12). The side walls (14), in cooperation with the bottom wall (12), define a water-tight cavity suitably dimensioned for receiving the head of a patient. The side walls (14) are composed of a plurality of inflatable tubular members (14A and 14B) that include an opening (16) so that the head of the patient may be placed within the basin (10) when the patient is in a prone position. The basin is provided within a support structure (32) secured to the bottom wall (12), and a resealable valve (30) disposed in a drain outlet (28) in fluid communication with the interior cavity of the basin (10).

16 Claims, 6 Drawing Sheets

INFLATABLE SHAMPOO BASIN

CROSS-REFERENCE TO RELATED APPLICATION

The present application claims the benefit of U.S. Provisional Application No. 60/400,206, filed Jul. 31, 2002, the disclosure of which is hereby incorporated by reference.

FIELD OF THE INVENTION

The present invention relates generally to a wash basin, and more particularly to portable wash basins which can be pneumatically inflated for use in facilities, such as hospitals, nursing homes, and the like.

BACKGROUND OF THE INVENTION

It is often difficult, if not impossible, for individuals confined to a bed to utilize conventional bathtubs and/or sinks to bathe or wash themselves. These individuals may be bed-ridden for various reasons, such as surgery, age, or disease. Many of these individuals are non-ambulatory and cannot be moved. Being confined to a bed also affects the patient when a patient desires simply for their hair to be washed without a complete bath. Typically, a patient has only two choices available for washing their hair. The first is to move the patient to a stationary sink over which the patient may lean to have their hair washed. However, this may be difficult due to the patient's physical condition or the physical demands made on the assistant. The other choice is to move the patient over to, and place them into, a conventional bathtub. However, attempting to wash a patient's hair in a conventional bathtub is both uncomfortable to the patient and ineffective due to the body position of the patient when disposed in a conventional bathtub. Additionally, the use of a bathtub poses serious safety concerns to the patient and unnecessary physical demands on the assistant.

Therefore, it is often the practice of hospitals, convalescent homes and nursing homes to rely on portable, inflatable wash basins, which have been suggested in the prior art. One such inflatable wash basin of the prior art is illustrated in U.S. Pat. No. D293,364 and includes a rectangular tubular wall section, which is inflatable to form the periphery of the basin. A heat sealable floor panel is connected to the lower periphery of the tubular wall section to define the water-tight basin. The tubular wall section includes an opening for accessing the interior cavity of the basin. The basin may be filled with water from a suitable water source, forming a reservoir for washing the patient's hair.

While the aforementioned prior art wash basin works well in its present application, the prior art wash basin suffers from several deficiencies. One such deficiency is the lack of head support for the patient during the washing process. In order to use the prior art wash basin, the patient either has to hold their head up, if at all possible, causing discomfort and strain to the patient, or the assistant must lift and hold the patient's head with one hand while attempting to shampoo the patient's hair with the other hand. Another such deficiency is the lack of a shut-off valve in the drain outlet so that the assistant may either stop or release the water from the basin conveniently, depending on the situation, without leaving the patient unattended. The prior art wash basin requires a clamp that surrounds the drain hose. The clamp is squeezed tightly in order to stop the flow of water, which is awkward to use and requires significant strength. Additionally, the clamp is susceptible to breaking if "over-clamped," making the wash basin unusable. Finally, the wash basin is susceptible to tearing when the neck opening is forced open to accommodate the head region of the patient. In one construction method of the prior art basin, the ends of the neck opening between the upper and lower tubular members is constructed with a straight-line heat seal, thereby acting like a zipper capable of tearing a hole in the wash basin when the neck opening is forced open.

SUMMARY OF THE INVENTION

The present invention provides a highly convenient pneumatically inflatable wash basin that addresses the deficiencies of the prior art. The wash basin is formed from a plurality of inflatable tubular members connected to a bottom wall, thereby forming a water-tight basin for washing a patient. Inlets and/or outlets are connected within the wash basin for inflating the tubular members and draining the wash basin of water after the washing process is complete, respectively. A head support is further provided to support the patient's head during the washing process, and a drain valve is included so that the assistant may either stop or release the water from the basin, depending on the situation, without leaving the patient unattended.

In accordance with an aspect of the present invention, a portable wash basin is provided. The portable wash basin includes a bottom wall constructed from an impermeable material. A plurality of inflatable side walls constructed from an impermeable material are connected to and extend upwardly from the bottom wall defining an interior cavity. An opening is disposed in one of the plurality of side walls for accessing the interior cavity from a position exterior of the side walls. The wash basin includes a resealable air valve disposed in pneumatic communication with the plurality of inflatable side walls. The resealable air valve may be connected to a source of air to inflate the side walls, and operable to deflate the side walls. The inflatable wash basin further includes a drain outlet in fluid communication with the interior cavity of the basin, and a resealable valve operable to allow fluid to drain through the drain outlet, and further operable to prohibit fluid from draining through the drain outlet.

In accordance with another aspect of the present invention, a portable wash basin is provided. The portable wash basin includes a bottom wall constructed from an impermeable material. A plurality of inflatable side walls constructed from an impermeable material are connected to and extend upwardly from the bottom wall defining an interior cavity. An opening is disposed in one of the plurality of side walls for accessing the interior cavity from a position exterior of the side walls. The wash basin also includes a resealable air valve disposed in pneumatic communication with the plurality of inflatable side walls. The resealable air valve may be connected to a source of air to inflate the side walls, and operable to deflate the side walls. A head support structure is further provided with the wash basin and is secured to the bottom wall for supported the head of the patient.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
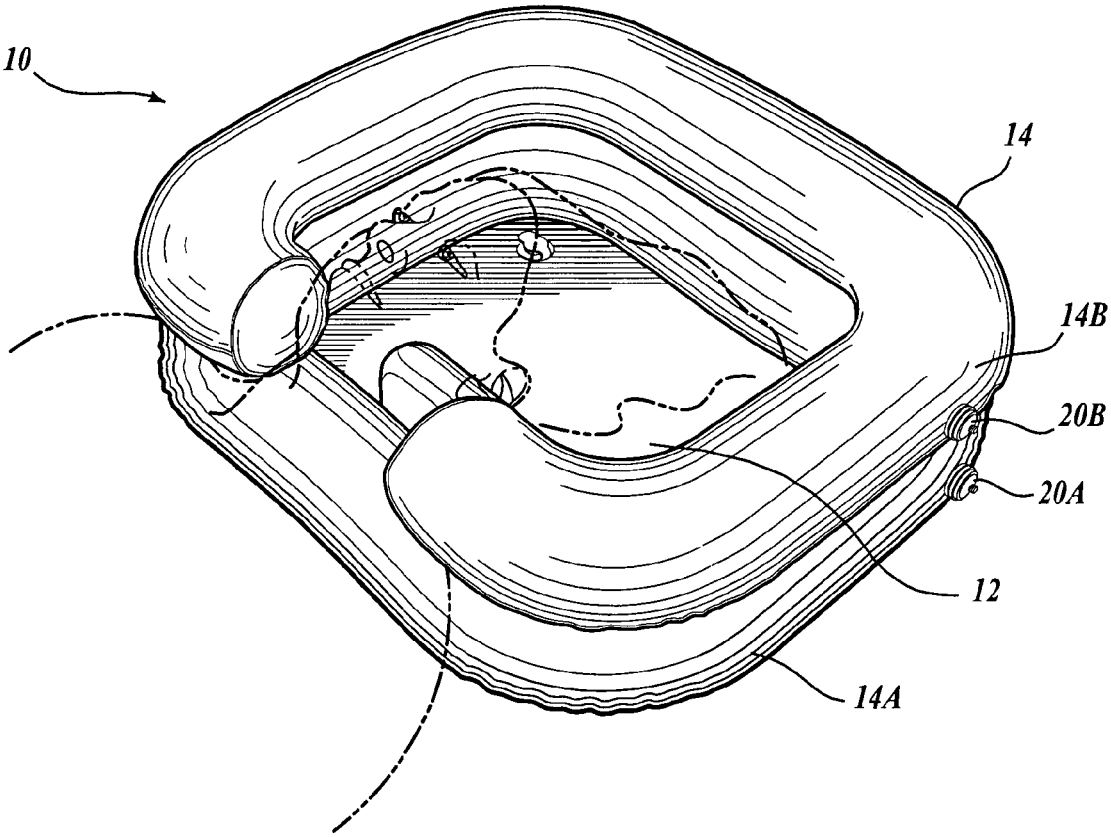
FIG. 1 is a perspective view of an inflatable wash basin constructed in accordance with the present invention.

The present invention will now be described with reference to the accompanying drawings where like numerals correspond to like elements. The present invention is an inflatable wash basin suitable for use with a patient confined to a bed in a hospital, nursing home, or the like so that the patient may wash their hair. One suitable embodiment of an inflatable basin, generally designated 10, constructed in accordance with the present invention is illustrated in FIGS. 1-12. Generally described, the inflatable basin 10 comprises a bottom wall 12 and upwardly extending side walls 14, which extend around the perimeter of the bottom wall 12. The side walls 14, in cooperation with the bottom wall 12, define a water-tight cavity suitably dimensioned for receiving the head of a patient. The side walls 14 include an opening 16 so that the head of the patient may be placed within the basin 10 when the patient is lying in a prone position. The basin 10 can be filled with water so that the patient may effectively wash their hair with the aid of an assistant.

Figure 2:
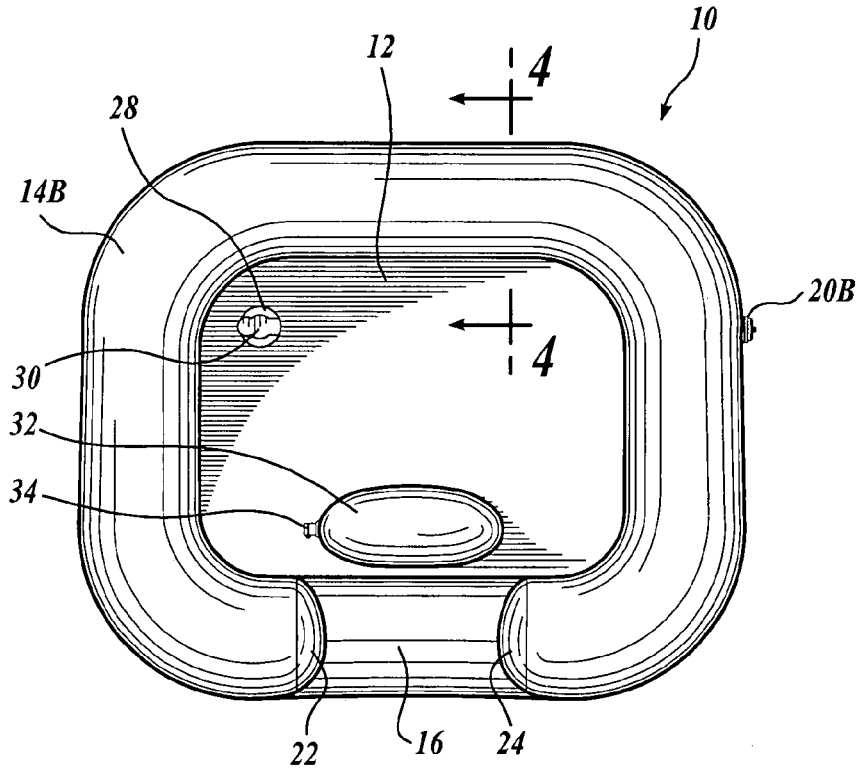
FIG. 2 is a top view of the inflatable wash basin shown in FIG. 1.
Figure 4:
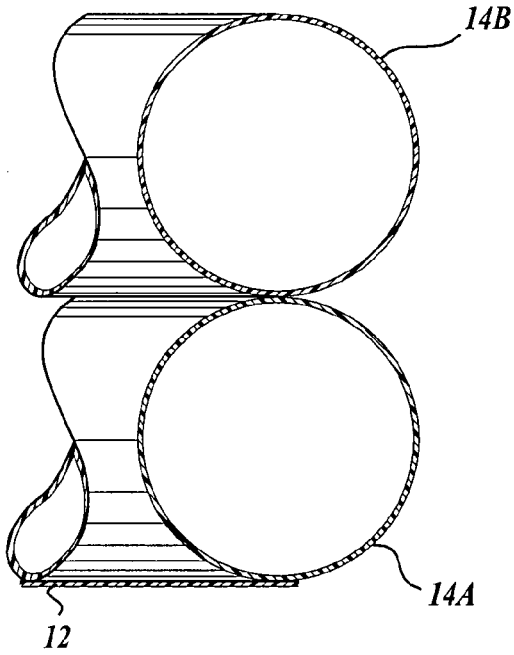
FIG. 4 is a partial cross section view taken along lines 4-4 in FIG. 2.

As shown in FIGS. 1 and 2, the inflatable basin 10 may be formed from a plurality of vertically stacked and interconnected inflatable tubular members 14A and 14B, connected to the bottom wall 12. The inflatable tubular members 14A and 14B are preferably circular in cross-section, having substantially the same cross-section dimension. The lowermost tubular member 14A is connected to the bottom wall 12 at the bottom wall's peripheral edge, the tubular members forming the peripheral side walls 14 of the basin 10. The bottom wall 12 has a rectangular shape and is constructed of an impermeable material, such as polyethylene or plasticized polyvinyl chloride (PVC) film. The bottom wall 12 is formed of a planer sheet having the strength and stability necessary to support the weight of the basin when filled with water. The bottom wall 12 is glued, heat sealed, or otherwise connected at its outer peripheral edges to the bottom surface of the tubular member 14A, as illustrated in FIG. 4.

While described above and illustrated herein has a sheet of material, it will be readily apparent that the bottom wall 12 may be constructed as an inflatable member or constructed with a padded floor surface comprising a layer of foam-rubber or the like covered by a water-tight covering. Alternatively, the padded floor can be constructed by an inflatable layer that overlays the bottom wall. In this particular embodiment, the inflatable layer could include a dedicated air valve for inflating and deflating, or could be constructed in communication with the inflatable tubular members 14A and inflated via an air valve 20A, as will be described in detail below.

Referring back to FIG. 1, the tubular members 14A and 14B are stacked one on top of the other, with tubular member 14B being the upper tubular member, remote from said bottom wall 12. The tubular members 14A and 14B are formed of an impermeable material, such as polyethylene or plasticized polyvinyl chloride (PVC) film, and can be easily fabricated and joined by adhesive or conventional heat sealing techniques known in the art. In one embodiment shown in FIG. 5, the tubular member 14A (hidden by tubular member 14B) and tubular member 14B are connected by a heat seal 40 having uniquely shaped ends 44, as will be described in more detail below. The tubular members 14A and 14B include resealable air valves 20A and 20B disposed in fluid communication with the interior of the tubular members 14A and 14B, respectively. Alternatively, the tubular members 14A and 14B may be interconnected in such a way as to permit inflation of both members 14A and 14B via one of the resealable air valves 20A or 20B.

As best shown in FIG. 2, the tubular member 14B is generally C-shaped when inflated, the ends 22 and 24 of which define the opening 16 for accessing the interior cavity of the basin 10. The opening 16 is positioned at one of the sides of the rectangular shaped basin 10 and is suitably dimensioned for receiving the neck region of the patient when the patient is lying in a prone position. As best shown in FIG. 1, the lower tubular member 14A supports the neck of the patient when the patient's head is within the interior cavity of the basin 10.

Figure 5:
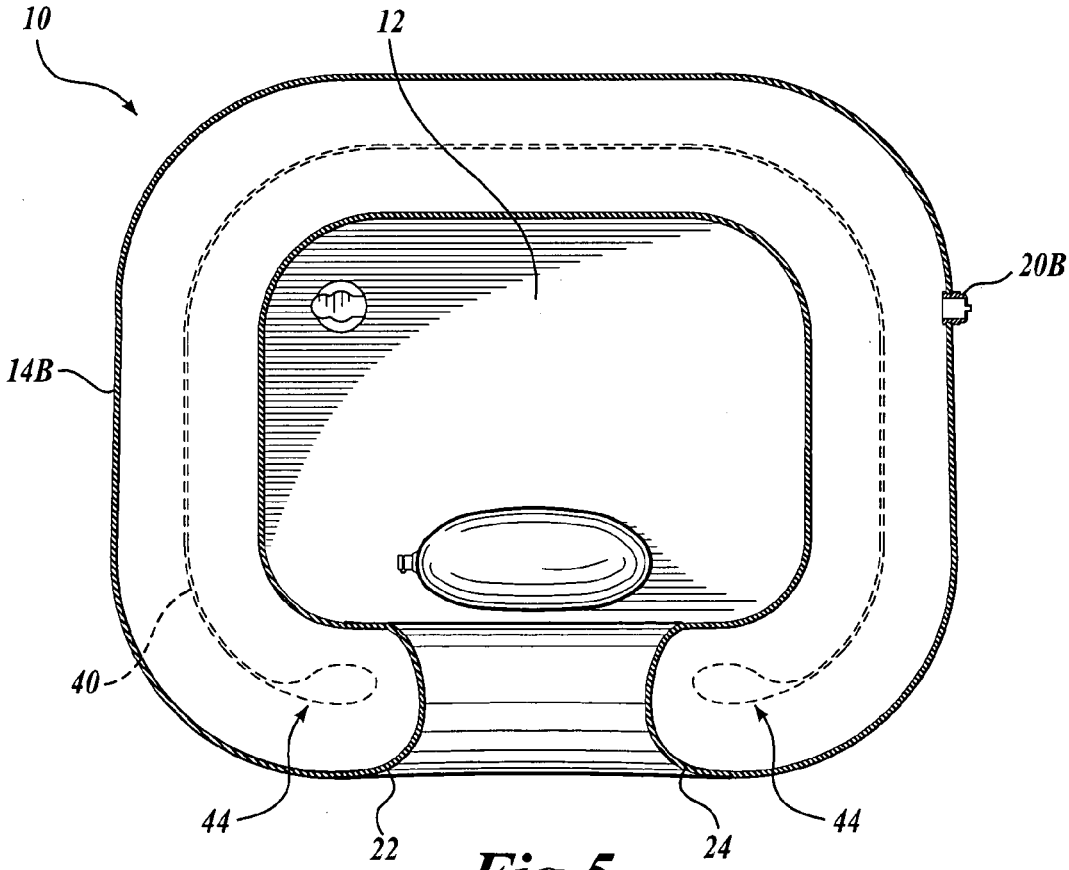
FIG. 5 is a cross section view taken along lines 5-5 in FIG. 3.
Figure 6:
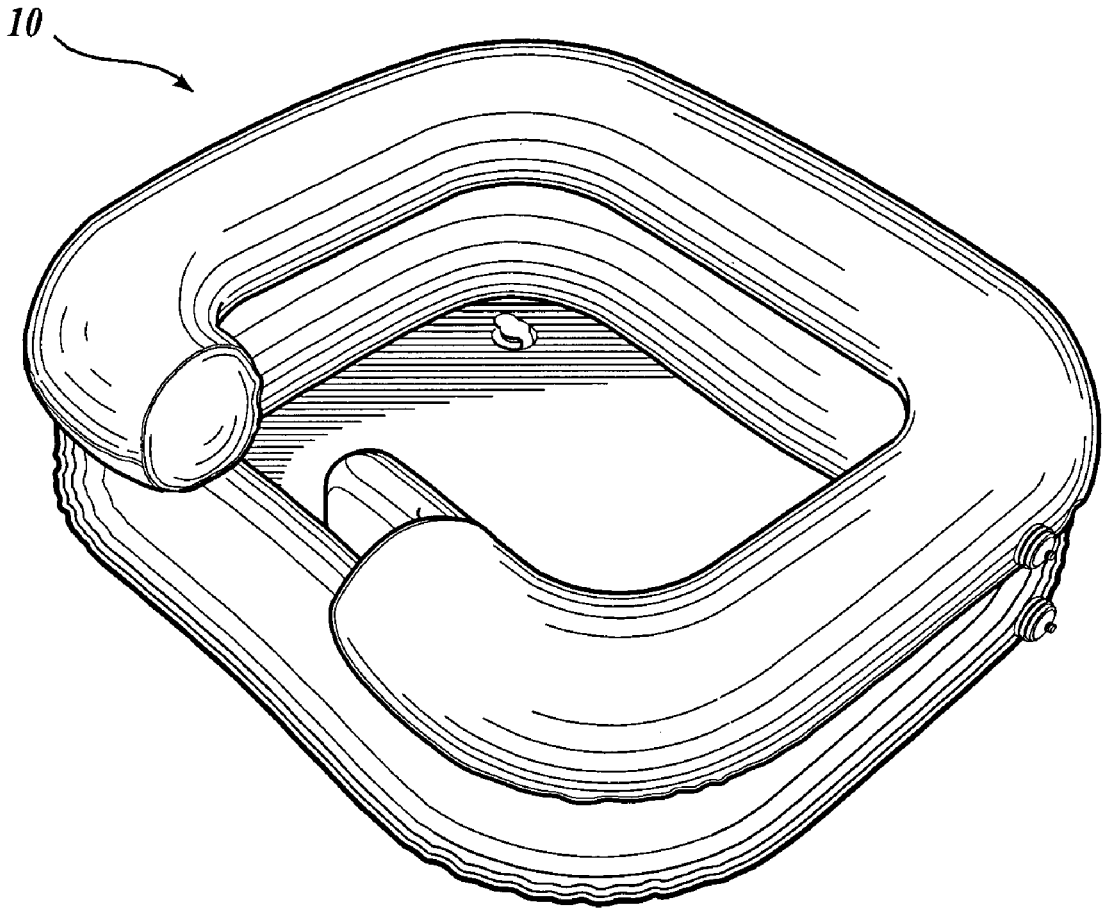
FIG. 6 is a perspective view of an inflatable wash basin of the present invention.
Figure 7:
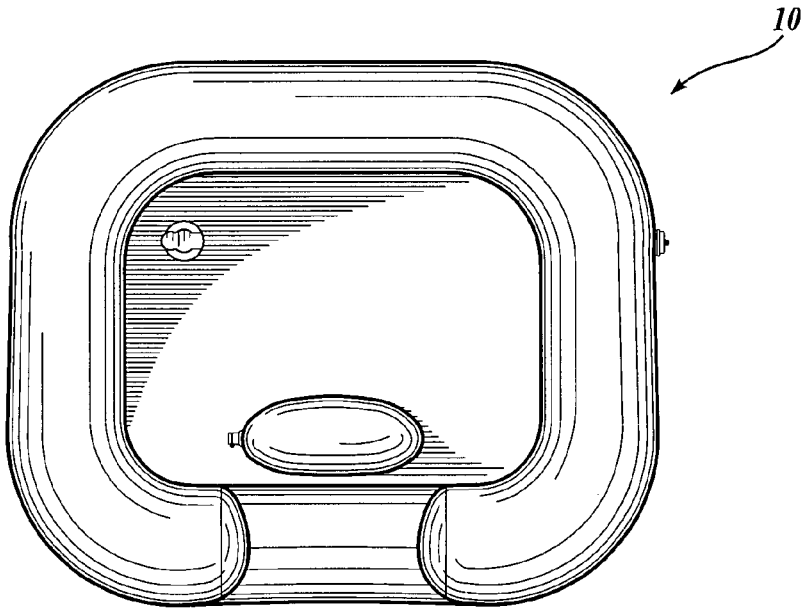
FIG. 7 is a top view of the inflatable wash basin of FIG. 6.
Figure 8:
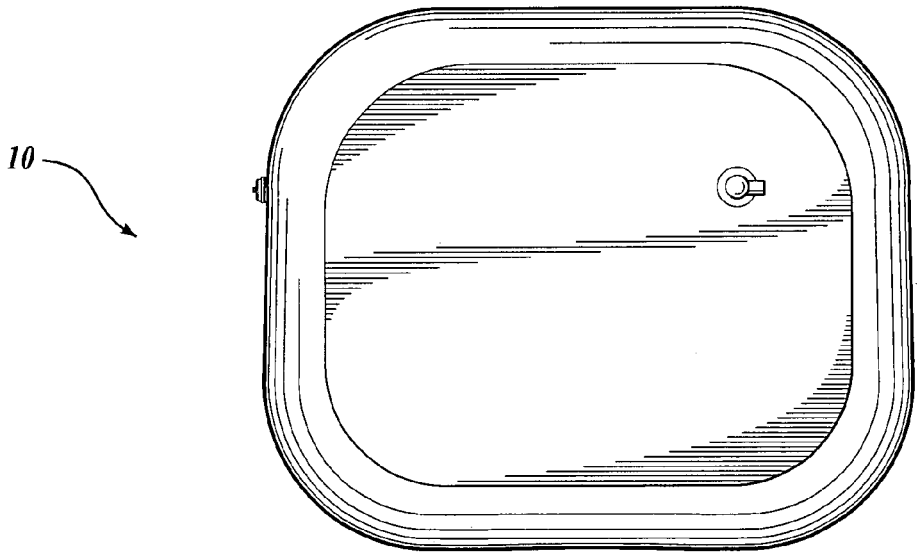
FIG. 8 is a bottom view of the inflatable wash basin of FIG. 6.
Figure 9:
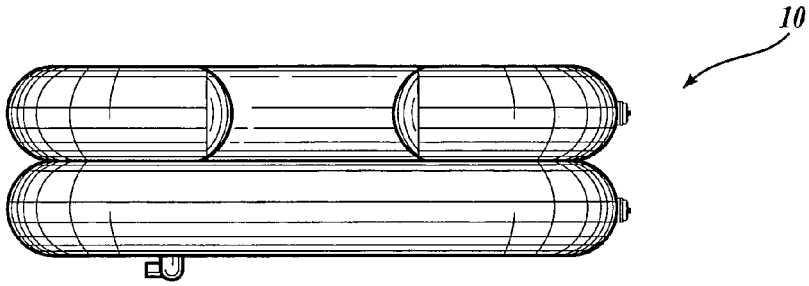
FIG. 9 is a front view of the inflatable wash basin of FIG. 6.
Figure 10:
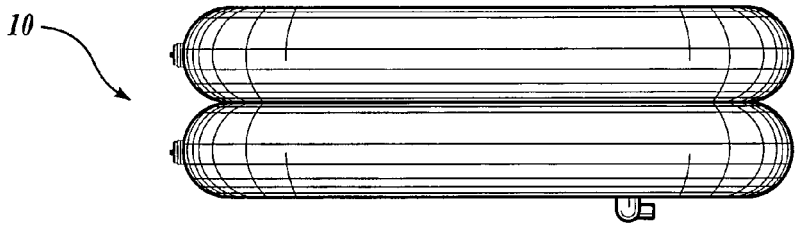
FIG. 10 is a rear view of the inflatable wash basin of FIG. 6
Figure 11:
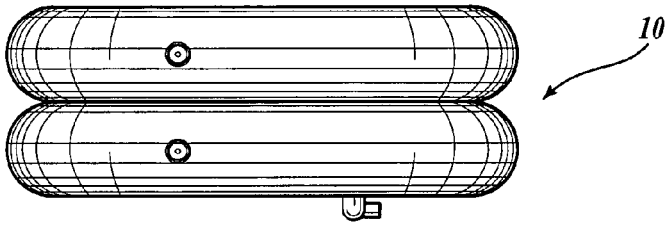
FIG. 11 is a side view of the inflatable wash basin of FIG. 6.
Figure 12:
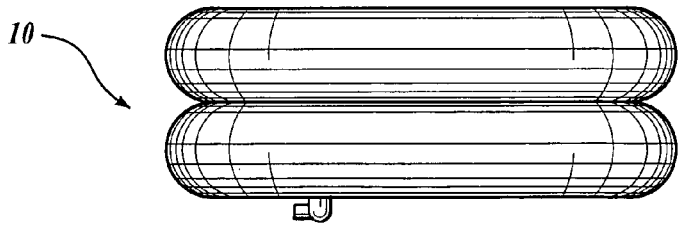
FIG. 12 is a side view of the inflatable wash basin taken from the side opposite of FIG. 11.

In one aspect of the present invention, the connection between the tubular members 14A and 14B is reinforced at a location where the ends 22 and 24 of the tubular member 14B connect to the tubular member 14A. This improves the ability of the basin to prevent tearing when the neck opening is forced opened. In one embodiment, the tubular members 14A and 14B are connected by a heat seal 40 forming a connection interface that terminates in bull nose or teardrop shaped heat seal ends 44 at the location where the ends 22 and 24 of tubular member 14B connect to the tubular member 14A, as best shown in FIG. 5. Specifically, as the heat seal 40 approaches the ends 22 and 24, the heat seal is formed with a bulbous region at end sections 44. The bulbous or teardrop shaped end sections 44, as opposed to the linear heat seal ends of the conventionally constructed prior art basin shown in U.S. Pat. No. D293,364, creates a larger surface area at the ends of the heat seal formed between the tubular members 14A and 14B. As such, the larger surface area of the tear drop shaped end sections 44 aids in the prevention of tearing or separating the tubular members 14A and 14B at the location where the ends 22 and 24 of the tubular member 14B connects to the tubular member 14A when the opening 16 is forced opened. It will be appreciated that the same approach may also be used if the tubular members 14A and 14B are connected using adhesive bonding techniques.

Figure 3:
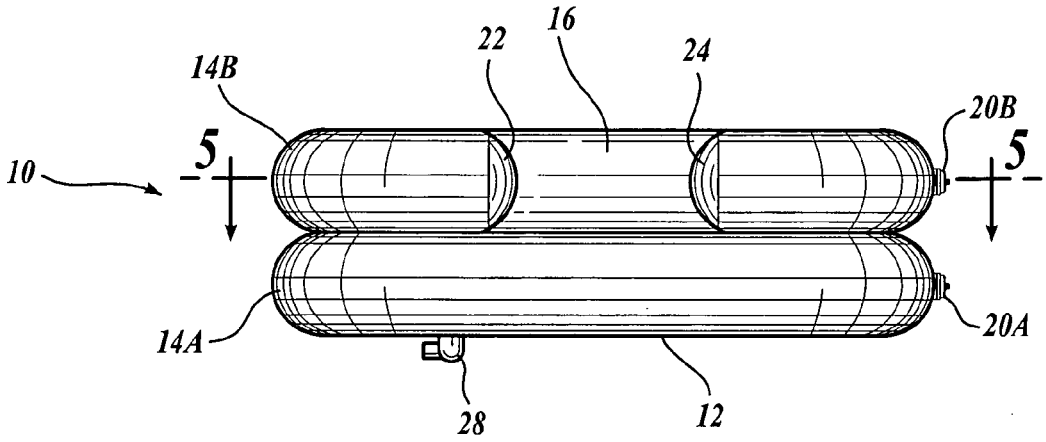
FIG. 3 is an elevational view of the inflatable wash basin shown in FIG. 1 taken from the opening side of the basin.

Referring now to FIGS. 2 and 3, a drain outlet 28 maybe provided in the bottom wall 12 in fluid communication with the interior of the basin to permit fluid to conveniently drain from the basin 10. The drain outlet 28 may be connected to a drain hose (not shown) external from the basin 10 to permit remote disposal of the used water. Any of a variety of connection techniques may be employed to connect the drain hose to the drain outlet 28. The drain outlet 28 may include a resealable valve 30 to selectively seal the outlet 28 so that the water may be maintained within the basin during use, and drained thereafter. Alternatively, if a drain hose is utilized in conjunction with the drain outlet 28, the drain hose may include an on-off valve well known in the art (such as a petcock type valve or a spring loaded plunger type valve) so that water may be maintained within the basin during use, and drained after the bathing process is complete.

Referring back to FIGS. 1 and 2, the basin 10 may further include an inflatable head support structure or pillow 32, to receive and support the head of the patient when the patient's head is disposed within the cavity of the basin 10. The pillow 32 is secured to the bottom wall 12 and positioned proximal to the opening 16 in the tubular member 14B. The pillow 32 has a dedicated resealable air valve 34 to inflate and deflate the pillow. However, depending on the size and location of the pillow 32, the pillow may be in fluid communication with tubular member 14A and inflatable via air valve 20A.

Using the inflatable basin 10 constructed in accordance with aspects of the present invention will now be described with reference to FIGS. 1-4. When the basin 10 is not in use, the basin 12 can be stored in a deflated condition. When a patient confined to a bed wishes to wash his/her hair, the basin 10 is transported to the patient's bed. The patient is permitted to remain on the bed as the basin 10 is unfolded. Tubular members 14A and 14B are then inflated via the air valves 20A and 20B. This can be readily accomplished by manually exhaling into the valve or by using an auxiliary air system, such as an air pump or with the exhaust port of a wet/dry vacuum. The inflation of the tubular members 14A and 14B will cause tubular members 14A and 14B to expand, thereby erecting the side walls 14. The head and upper torso of the patient may then be moved upward to a position such that the basin may be positioned under the patient's head.

Once the basin is in position, the head of the patient is lowered within the cavity of the basin 10 such that the patient's neck is disposed within the opening 16 of the tubular member 14B and supported by the tubular member 14A. If the pillow 32 is inflated, the patient's head is also positioned to be supported by the pillow 32. The basin 10 can be filled with water from a suitable water source prior to or after the patient's head is lowered within the cavity of the basin 10. Prior to filling the basin 10 with water, the valve 30 positioned in the outlet 28 is disposed in a closed or sealed position.

After the patient's hair is washed, the valve 30 is opened and the used water drains from the basin 10 via the drain hose due to the effect of gravity. If the drain rate of the basin is too slow, it will be appreciated by those skilled in the art that an optional water pump can be connected to the drain hose in any conventional manner to aid in the drainage of basin 10. When the water is entirely drained from the basin and the patient's head is removed from the basin 10, the basin 10 may be deflated by opening the air valves 20A and 20B, permitting air within the tubular members 14A and 14B to be released. Prior to or after deflating the basin 10, the basin 10 may be towel dried or may be dried via a wet/dry vacuum. Alternatively, the basin 10 may be hung up in a vertical orientation via hooks (not shown) to permit efficient air drying. After the basin 10 is deflated and dried, the basin 10 may then be folded into a relatively compact unit for convenient storage during periods of non use. Prior to storing the basin 10, the basin 10 may be cleansed and sanitized as desired.

While the preferred embodiment of the invention has been illustrated and described, it will be appreciated that various changes can be made therein without departing from the spirit and scope of the invention. For example, while the illustrative basin 10 included two stackable tubular members, it will be readily evident that any number of tubular members of suitable size may be used to form the side walls of basin 10.

The embodiments of the invention in which an exclusive property or privilege is claimed are defined as follows:

1. A portable washing device, comprising:

a bottom wall constructed from an impermeable material;

a plurality of inflatable side walls constructed from an impermeable material connected to and extending upwardly from said bottom wall defining an interior cavity, wherein said plurality of inflatable side walls include a lower inflatable tubular member constructed from an impermeable material connected to and extending around said bottom wall, and an upper inflatable tubular member having first and second ends, said upper tubular member being stacked upon and connected to said lower tubular member, said upper tubular member extending around a majority of said lower tubular member, wherein said tubular members define, in cooperation with said bottom wall, a basin;

an opening disposed in one of said plurality of side walls for accessing said interior cavity from a position exterior of said side walls, said ends of said upper tubular member defining said opening; and a connection formed by or between an external surface of said upper inflatable tubular member and an external surface of said lower inflatable tubular member extending along a majority of the external surface of said upper tubular member and including a center line, said connection including at least one segment disposed transverse to said center line for connection reinforcement to prevent separation of said upper tubular member from said lower tubular member when a force is applied from said opening to said first or second upper tubular member end along said center line, wherein said segment of the connection between the external surface of said lower tubular member and the external surface of said upper tubular member at either of said ends of said upper tubular member is formed as a teardrop shaped heat seal.

2. The device of claim 1, wherein said tubular members are approximately the same dimension.

3. The device of claim 1, wherein said tubular members are circular in cross-section.

4. The device of claim 1, further comprising a resealable air valve disposed in pneumatic communication with said plurality of inflatable side walls, said resealable air valve connectable to a source of air to inflate said side walls, and operable to deflate said side walls.

5. The device of claim 1, further comprising a drain outlet in fluid communication with said interior cavity of said basin.

6. The device of claim 5, further comprising a resealable valve operable to allow fluid to drain through said drain outlet, and further operable to prohibit fluid from draining through said drain outlet.

7. The device of claim 1, further comprising an inflatable head support structure secured to said bottom wall adjacent said opening.

8. A portable washing device, comprising:

a bottom wall constructed from an impermeable material, the bottom wall having an outer perimeter;

a lower inflatable tubular member constructed from an impermeable material connected to and extending around said perimeter of said bottom wall;

an upper inflatable tubular member having first and second ends, said upper inflatable tubular member being stacked upon said lower tubular member and extending around a majority of said lower tubular member such that an opening is created between the first and second ends, said opening permitting access from a position exterior of said tubular members to an interior cavity formed by said tubular members and said bottom wall; and a seam interconnecting an external surface of the upper inflatable tubular member and an external surface of the lower inflatable tubular member, wherein said seam has a center line and extends along a majority of the external surface of said upper tubular member and terminates at seam reinforcement portions at its ends, wherein said seam reinforcement portions are configured for preventing separation of said upper tubular member from said lower tubular member when a force is applied from said opening against said first or second upper inflatable tubular member end along the seam center line.

9. The device of claim 8, further including a drain outlet in fluid communication with said interior cavity; and a resealable valve operable to allow fluid to drain through said drain outlet, and further operable to prohibit fluid from draining through said drain outlet.

10. The device of claim 8, further comprising an inflatable head support structure secured to said bottom wall adjacent said opening.

11. A portable washing device, comprising:

a bottom wall constructed from an impermeable material, the bottom wall having an outer perimeter;

a lower inflatable layer constricted from an impermeable material and connected to and extending around said perimeter of said bottom wall;

an upper inflatable layer having first and second ends, said upper inflatable layer being stacked upon said lower tubular member and extending around a majority of said lower inflatable layer such that an opening is formed between the first and second ends, said opening permitting access from a position exterior of said side walls to an interior cavity formed by said inflatable layers and said bottom wall;

a connection formed by or between an external surface of said upper inflatable layer and an external surface of said lower inflatable layer that connects the external surface of said upper layer to the external surface of said lower layer, said connection extending along a majority of the external surface of said upper inflatable layer and having a center line; and means for preventing the separation of the external surface of said upper inflatable layer from the external surface of said lower inflatable layer when a force is applied from said opening against said first or second upper inflatable layer end along said connection center line that would otherwise separate said upper inflatable layer from said lower inflatable layer absent said means for preventing the separation of the external surface of said upper inflatable layer from the external surface of said lower inflatable layer, wherein said means includes an increased cross-sectional contact area of the connection in proximity of the ends of the upper inflatable layer as compared to the remaining portion of the connection.

12. The device of claim 11, wherein said connection is an adhesive layer.

13. The device of claim 11, wherein said connection is formed by a heat seal.

14. The device of claim 11, wherein said means includes a portion of increased connection area disposed at said first and second ends.

15. The device of claim 14, wherein said portion has a bulbous shape.

16. The device of claim 11, further comprising an inflatable head support structure secured to said bottom wall adjacent said opening.

* * * * *

UNITED STATES PATENT AND TRADEMARK OFFICE

CERTIFICATE OF CORRECTION

PATENT NO. : 7,234,176 B1
APPLICATION NO. : 10/629312
DATED : June 26, 2007
INVENTOR(S) : C.-C. Chiu It is certified that error appears in the above-identified patent and that said Letters Patent is hereby corrected as shown below:

| COLUMN | LINE | ERROR |
|---|---|---|
| 7 (Claim 11, line 4) | 39 | "constricted" should read --constructed-- |

Signed and Sealed this

Eighteenth Day of December, 2007

JON W. DUDAS
*Director of the United States Patent and Trademark Office*